US011647845B2

(12) United States Patent
Colebrook et al.

(10) Patent No.: US 11,647,845 B2
(45) Date of Patent: May 16, 2023

(54) CHANGING TABLE

(71) Applicant: ASTOR-BANNERMAN (MEDICAL) LTD., Andoversford (GB)

(72) Inventors: Mark Colebrook, Cheltenham (GB); Guy Cowdry, Cheltenham (GB); Peter Deverson, Teddington (GB)

(73) Assignee: ASTOR-BANNERMAN (MEDICAL) LTD., Andoversford (GB)

( * ) Notice: Subject to any disclaimer, the term of this patent is extended or adjusted under 35 U.S.C. 154(b) by 133 days.

(21) Appl. No.: 17/212,990

(22) Filed: Mar. 25, 2021

(65) Prior Publication Data

US 2022/0061547 A1 Mar. 3, 2022

(30) Foreign Application Priority Data

Mar. 4, 2020 (GB) ..... 2003150

(51) Int. Cl.
*A47D 5/00* (2006.01)

(52) U.S. Cl.
CPC ..... *A47D 5/003* (2013.01); *A47D 5/006* (2013.01)

(58) Field of Classification Search
CPC ..... A61G 7/0005; A61G 1/013; A47K 3/06; A47K 3/064; Y10S 5/90; Y10S 5/947; A47D 5/006; A47D 5/003; A47D 15/008; A47D 5/00
See application file for complete search history.

(56) References Cited

U.S. PATENT DOCUMENTS

| | | | | |
|---|---|---|---|---|
| 3,839,754 | A * | 10/1974 | Hooper | A47D 5/006 248/164 |
| 4,713,850 | A | 12/1987 | Flaherty et al. | |
| 2014/0201920 | A1* | 7/2014 | Gant | A47D 5/006 5/655 |
| 2015/0014363 | A1 | 1/2015 | Buell et al. | |
| 2018/0020843 | A1* | 1/2018 | Hornor | F16M 11/38 5/655 |

FOREIGN PATENT DOCUMENTS

| | | |
|---|---|---|
| GB | 2280366 A | 2/1995 |

* cited by examiner

*Primary Examiner* — David R Hare
*Assistant Examiner* — Madison Emanski
(74) *Attorney, Agent, or Firm* — Ward Law Office LLC; Jacob M. Ward

(57) ABSTRACT

A changing table has a changing surface on which an individual can lie to be changed or washed. The changing surface is formed from a sheet of semi-rigid material having a longitudinal center axis and having also, parallel to the center axis, first and second edges occupying nominal rest positions with respect to each other when there is no load on the surface, the said edges being fixed to first and second longitudinal members, the sheet and longitudinal members forming together a support system having for the first 10 mm of extension between the said center line and the said nominal rest position of the said first edge and between the said center line and the said nominal rest position of the said second edge an average spring rate in extension of more than 300 N/mm and the said semi-rigid sheet having a torsion coefficient of more than 10 Nm/radian.

18 Claims, 5 Drawing Sheets

CHANGING TABLE

CROSS REFERENCE TO RELATED APPLICATIONS

This application claims the benefit of U.K. Patent Application No. GB2003150.6, filed on Mar. 4, 2020. The entire disclosure of the above application is incorporated herein by reference.

FIELD

The disclosure relates to changing tables.

INTRODUCTION

Changing tables provide a surface on which an individual can lie while being washed or changed. The most common and best-known types of changing tables are baby changing tables, used primarily to change a baby's diaper. These can be found at home and also in public spaces, where wall-mounted changing tables with a fold-down changing surface are popular. Larger changing tables to accommodate older children as well as adults have also been available for many years. They are commonly referred to as adult changing tables, changing benches, or adult nursing benches. Typically, they are used to wash and change individuals with limited mobility or individuals with disabilities that limit their ability to change themselves. These larger changing tables may be free-standing, mobile on castors, or wall-mounted, as well as other configurations. They may also be height-adjustable. Increasing numbers of public spaces are now installing adult-size changing tables.

Changing tables need to strike a balance between comfort, usability, durability and hygiene. This is particularly the case in the case of changing tables installed in public spaces where they may be used hard and possibly vandalized, while at the same time being often only cursorily cleaned.

Currently there are known several types of adult changing table. The first has a changing surface comprising a board made of plywood, grp board, or a similar material. A board without a mattress provides a durable, easily cleaned surface. However, it is uncomfortable for the user and can often be frightening for a nervous or disabled individual because they feel as though they are lying on top of the surface rather than in it, with a greater perceived risk of falling off.

Variants of this first type include a pad to make lying on the board more comfortable. The pad may be upholstered onto the board or be a detachable mattress. Although these pads improve comfort, they do nothing to improve the feeling of security and are materially worse than a plain board in terms of hygiene and durability.

A further type of changing table has a changing surface formed by a high-tensile fabric material such as tarpaulin or HT polyester stretched tautly within a tubular steel frame. When an individual lies on the surface, it hammocks around them, giving a comfortable feeling of security. It is also easy to clean, with all surfaces accessible. However, it suffers two disadvantages. The first is the amount of hammocking of the surface will increase with a person's weight. This is a significant problem where an individual needs to be rolled onto their side, for example to clean them. As a person becomes heavier it becomes disproportionately harder to roll them as they sink lower into the material. The second disadvantage is that an individual lying on the surface will be surrounded by a hard steel frame. If the person has a tendency to thrash, this can be dangerous. Even for people who are lying calmly, the sensation of being surrounded by thinly covered metal can be disconcerting.

Various solutions to this problem have been tried. The most popular is to add a tube of foam rubber around the steel frame. This is effective in protecting the individual from hurting themselves against the steel frame. But it makes it harder to get someone on and off the surface because of the lip it introduces. It is also likely to reduce even further the possibility of rolling a heavy person. It can also obscure an individual's view when they lie on the surface.

The tarpaulin or HT material has the further disadvantage of being vulnerable to damage, especially vandalism. Changing tables have been developed on which the surface can be quickly removed and replaced—zipped on and off, for example. This does not solve the problem of damage but does make it easier to repair vandal-damaged changing tables.

There is a continuing need for an adult changing table that is durable enough for public use, has a hygienic design and which is also comfortable, easy to use and feels safe to lie on for a wide range of individuals. The present disclosure aims to provide such a table.

SUMMARY

According to the present disclosure there is provided a changing table having a changing surface on which an individual can lie to be changed or washed, thereby providing a load on the surface, characterized in that the said changing surface is formed from a sheet of semi-rigid material having a longitudinal center axis and having also, parallel to the said center axis, first and second edges occupying nominal rest positions with respect to each other when there is no load on the surface, the said edges being fixed to first and second longitudinal members, the sheet and longitudinal members forming together a support system having for the first 10 mm of extension between the said center line and the said nominal rest position of the said first edge and between the said center line and the said nominal rest position of the said second edge a combined average spring rate in extension of more than 300 N/mm and the said semi-rigid sheet having a torsion coefficient of more than 10 Newton meters/radian, whereby the sheet can hammock a small amount in a predetermined manner when lain on by an individual.

In certain embodiments, the said sheet of semi-rigid material is fixed to at least one of the said longitudinal members by means allowing a small amount of elastic movement between the said members and the said sheet.

In certain embodiments, the said first and second longitudinal members are fixed to a frame that has for the first 10 mm of compression an average spring rate in compression measured between the longitudinal members of more than 300 N/mm.

In certain embodiments, the said sheet of semi-rigid material is fixed to at least one longitudinal member by means of a clamping member.

In certain embodiments, the said sheet of semi-rigid material is fixed to at least one of the longitudinal members by means of bolts passing through compressible grommets set in the said sheet.

In certain embodiments, the said sheet of semi-rigid material is formed from sheet steel.

In certain embodiments, the said sheet of semi-rigid material is formed from polyethylene.

In certain embodiments, the said sheet of semi-rigid material is formed from plywood.

In certain embodiments, the said sheet of semi-rigid material is formed from GRP sheet.

In certain embodiments, the said sheet of semi-rigid material is between 4 mm and 12 mm thick.

In certain embodiments, the clamping member exerts a clamping force on the said sheet by means of bolts passing through the said sheet.

In certain embodiments, the sheet extends to cover these extensions and is fixed to them in the same manner as it is fixed to the longitudinal members. The effect of this is to give a slightly shorter unsupported span of sheet between at either end. Because of this, the sheet will deflect less at the ends, where the head and feet are, compared with at the middle. This has been found to improve comfort for some individuals.

By using a semi-rigid sheet with an appropriately chosen torsion coefficient in conjunction with a mounting of the sheet that provides a high spring-rate in extension, the present disclosure is able to provide a changing surface with a very precisely set combination of comfort and hammocking. The torsion rate of the semi-rigid sheet determines how much the surface will sag under an initial load. Due to the vector nature of the forces. The high spring rate in extension will provide a low practical limit to the amount of sag, significantly improving handing and turning of an individual. The semi-rigid surface at the same time offers considerable advantages in terms of durability and protection against vandalism compared with a changing table of similar comfort.

DRAWINGS

The present disclosure will now be further described with reference to the accompanying drawings.

DETAILED DESCRIPTION

Figure 1:
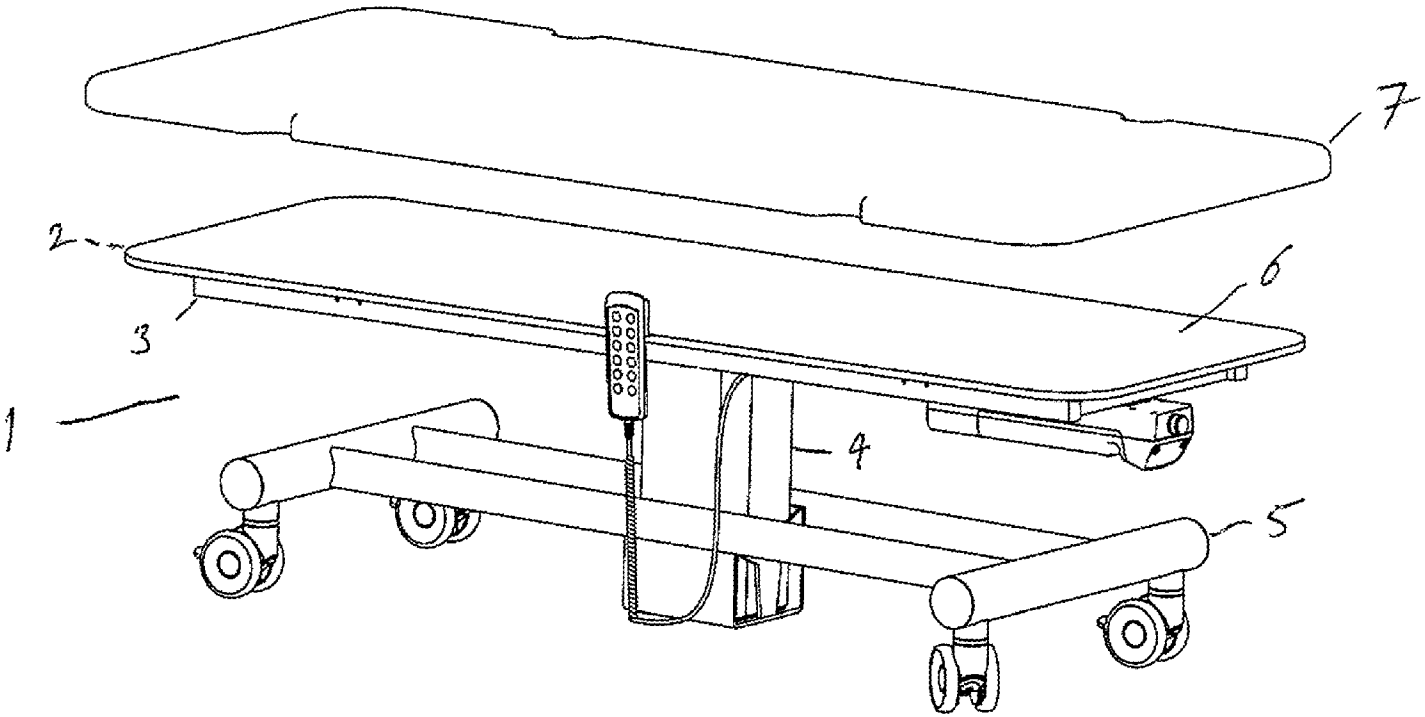
Fig 1 PRIOR ART
FIG. 1 is a known changing table, according to the prior art.

FIG. 1 shows a known type changing table 1 comprising a changing surface 6 provided by a rigid board 2 supported on a subframe 3. The subframe itself is supported on a height-adjustable electric actuator 4 in the current example, which is itself supported by a trolley base 5. The top surface 6 of the board 2 is made of a hygienic wipe-clean material, for example GRP. In use the changing surface can be raised to a height appropriate for a given carer or lowered to allow a direct transfer from a wheelchair. An individual lies on the board 2 while being changed or washed. It will be seen that the surface is not very comfortable and does not feel secure when an individual is lying on it or being turned on it. Polyurethane foam pads can be added or a mattress 7, shown for clarity in air above the changing surface 6. However, with either polyurethane pads or a mattress, it introduces a significant risk of trapping dirt and matter between the pads or mattress 7 and the surface 6. An upholstered surface can alternatively be used. But this greatly increases replacement costs if the upholstered surface gets damaged because the whole top needs to be replaced or sent away.

Figure 2:
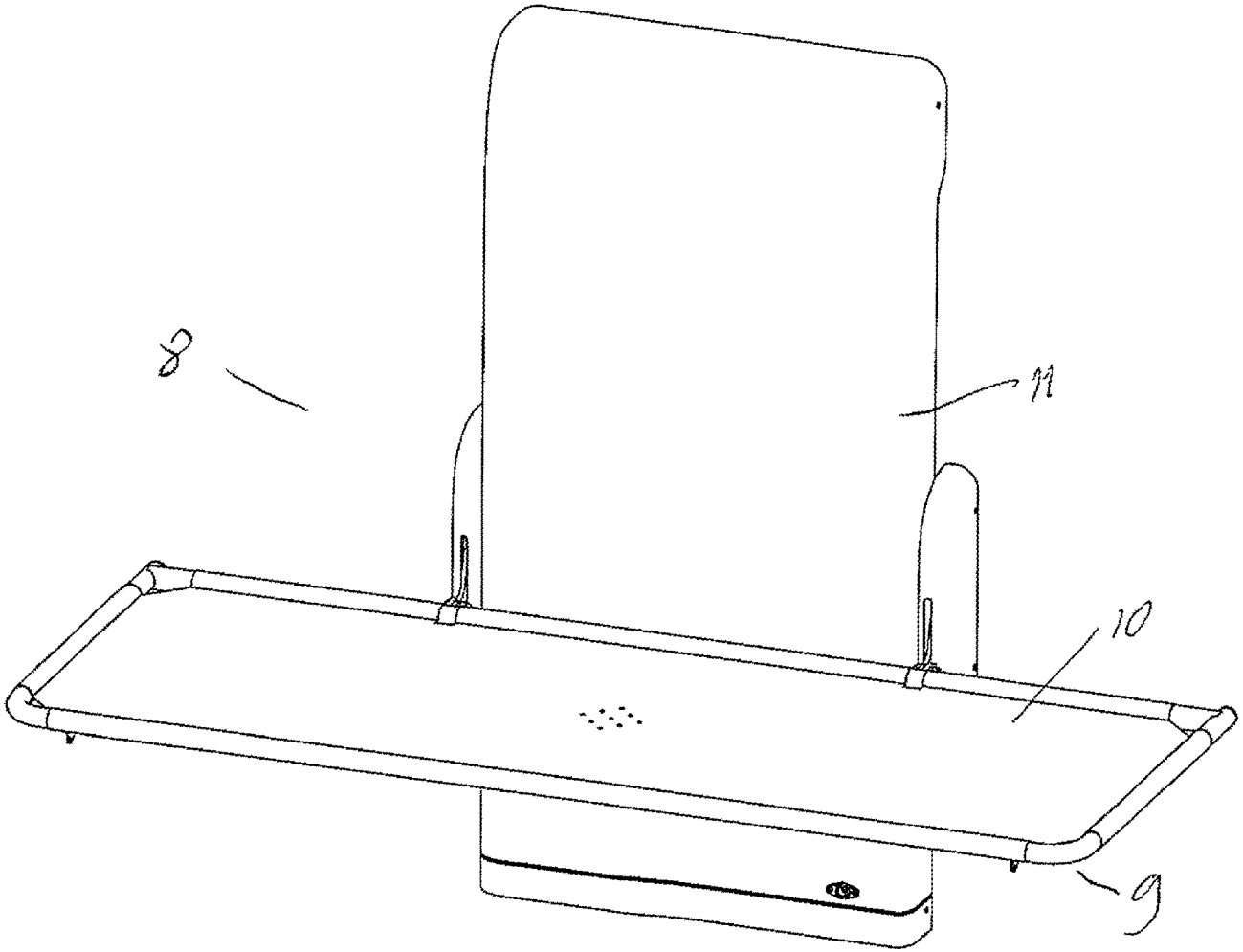
Fig 2 PRIOR ART
FIG. 2 is another type of known changing table, according to the prior art.

FIG. 2 shows another known type of changing table 8. This type comprises a tubular steel frame 9 over which a wipe-clean high-tensile fabric such as HT polyester is tautly stretched to provide a changing surface 10. In the example shown, the tubular frame 9 is supported by a wall-fixed height adjustment mechanism 11 which allows the changing surface 10 to be raised and lowered to an appropriate height. Typically, the frame 9 will be pivotable to allow it to stow against the wall-fixed mechanism 11. The surface 10 is hygienic, having nowhere to trap matter, with the underside accessible when it is folded up.

In use an individual lies on the surface 10. The weight of the individual stretches the high-tensile fabric allowing it to hammock around them. This provides a comfortable and secure-feeling experience for the individual. However, it has a number of disadvantages. The high-tensile surface is easy to damage. The steel frame is hard and protruding. An individual with a tendency to move or thrash can easily bruise themselves. Heavier people can sink into the surface to a point where it is hard to get them out and very hard to roll them for cleaning or changing. Also, the more an individual sinks into the surface 10, the more they find themselves looking round at a metal frame—as well as increasing the risk of bruising as the metal frame moves further up round their body and becomes easier to hit accidentally. Padding can be added to the frame to mitigate the risk of bruising but this increases the difficulty of getting off the bed as well as increasing the sensation of being surrounded by the frame.

Figure 3:
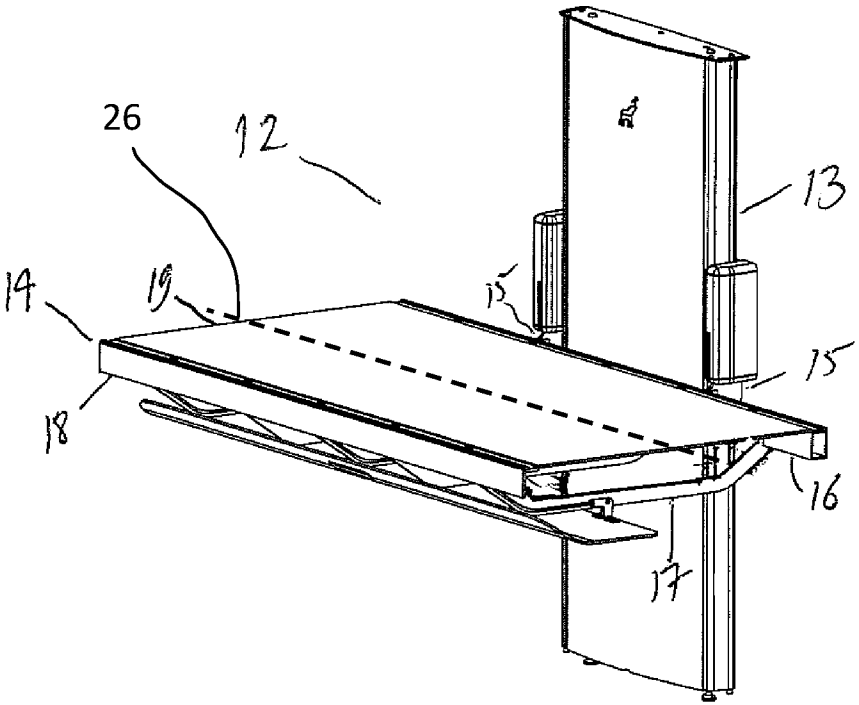
FIG. 3 is a changing table, according to a first embodiment of the present disclosure.

FIG. 3 shows a changing table 12 incorporating a first embodiment of the present disclosure.

The changing table 12 comprises a wall-fixed height adjustment mechanism 13 to which is attached a frame 14 by means of pivoting brackets 15, 15 which allow it to fold between a use position, shown, and a non-use position. The frame includes 14 a first longitudinal member 16, fixed directly to the pivoting brackets in this embodiment. A number of U-shaped brackets 17 connect the first longitudinal member to a second longitudinal member 18. The longitudinal members 16 and 18 have respective upper surfaces, hidden from view in the drawing, which are substantially horizontal when the frame 14 is in its use position.

Fixed to the upper surfaces of the longitudinal members and extending between them is a flexible semi-rigid sheet of material 19, the top face of which provides a changing surface. In the current embodiment the sheet is made from steel 1.2 mm in thickness. In the embodiment shown the sheet 19 is welded to the longitudinal members along opposite edges.

The semi-rigid sheet 19 has a longitudinal center axis 26 parallel to the first and second longitudinal members 16, 18.

Before it is loaded the sheet is initially substantially flat. When loaded—for example when an individual is laid upon it—the combination of the material of the sheet and the way it is supported allows it to hammock a very small amount—typically 10-20 mm at the place of greatest deflection. In this embodiment the U-shaped brackets are narrow in section and deform elastically to allow around 7 mm amount of relative movement between the longitudinal members 16 and 18 when the bed is loaded to its maximum specified weight, allowing the sheet 19 to hammock slightly. The support arrangement of the sheet combined with its semi-rigid nature is such that the distance the sheet deflects varies very little with the weight of the body lying on it. As a result, both smaller and larger individuals can be got onto and off from the sheet with relative ease, as well as being rolled while on the sheet. The semi-rigid nature of the steel sheet 19 allows it to move to accommodate different body shapes even though it does not itself materially stretch when loaded. This combination allows for a relatively comfortable changing table in use.

Because the sheet 19 itself extends to the edge of the bed, the longitudinal members 16, 18 and frame 14 are fully shielded, preventing an individual hitting against them and injuring themselves. Likewise, there is no surrounding frame visible when an individual is lying on the sheet. By virtue of its all-steel construction this embodiment is particularly durable.

Figure 4:
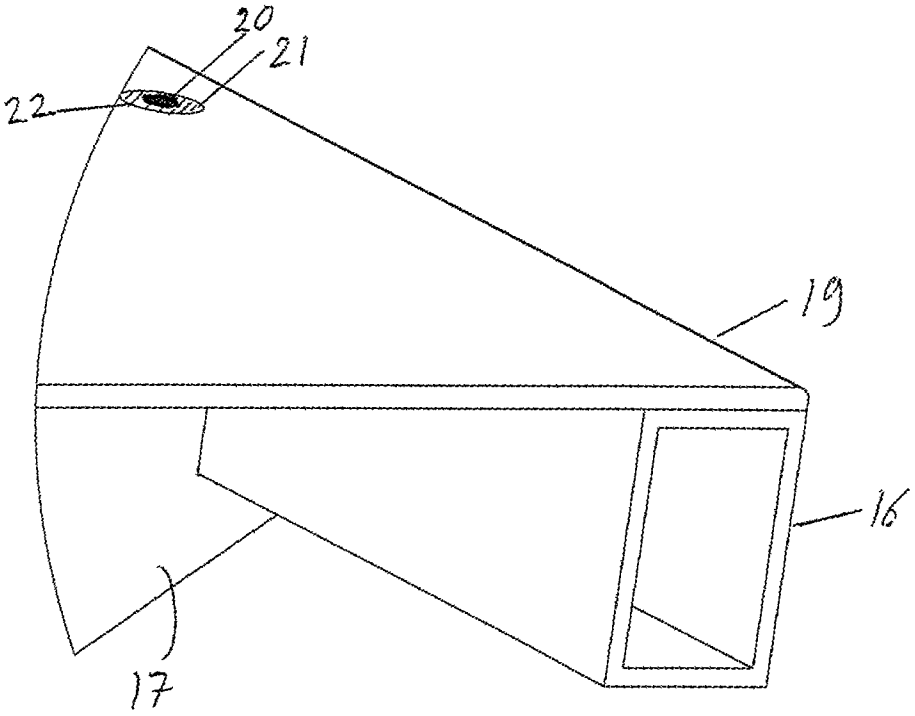
FIG. 4 is the changing table, as shown in FIG. 3.

FIG. 4 shows a detail of a second embodiment of the current invention. This embodiment is similar to the first embodiment except that the U-shaped brackets 17 are more substantial and the sheet 19 is bolted to the respective longitudinal members rather than being welded. The detail of FIG. 4 shows one of these bolt fixing points. The bolt is a shoulder bolt 20 passing through a slightly compressible grommet 21 which is itself set in a hole 22 through the sheet 19. The embodiment of FIG. 4 functions in the same way as the embodiment of FIG. 3 except that it allows a little more hammocking of the sheet 19 as an initial load is applied. It should be noted that if less initial hammocking is desired with this embodiment, a thicker steel sheet can be used to increase the torsional coefficient of the sheet, in accordance with the invention. Once the grommets are fully compressed, the sheet will not deflect significantly further when a light or heavy load is put on it, allowing equal comfort and maneuverability with a wide range of individuals. A further variation of this embodiment has bolts passing through oversize holes without grommets.

Figure 5:
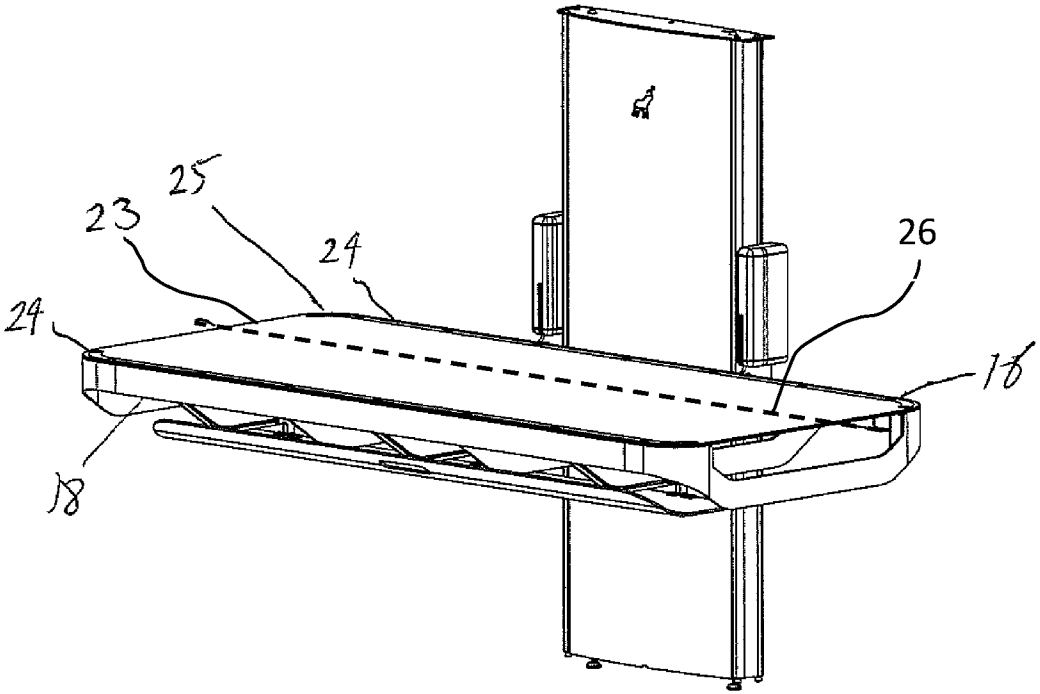
FIG. 5 is the changing table, as shown in FIGS. 3-4.

FIG. 5 shows a further embodiment of the current invention. In this embodiment the changing surface is made from a sheet 23 of Polyethylene 10 mm in thickness. The sheet 23 is firmly fixed to the longitudinal members along opposite edges. The sheet 23 has a longitudinal center axis 26 parallel to the longitudinal members. In the embodiment showing it is through-bolted to the longitudinal members as well as being clamped by clamping members 24, 24. The slight elasticity of the Polyethylene, primarily where it is fixed to the longitudinal members 16, 18, allows a similar amount of hammocking to the embodiment of FIG. 4. The plastic also gives a warmer, softer feel. Different types and thicknesses of Polyethylene or polymer plastic allow different torsional coefficients and spring rates in extension to provide the desired combination of initial movement and ultimate hammocking under maximum specified load.

It will be seen that the embodiments of the invention introduce an opportunity for a very well-controlled amount of extension between a center line of the sheet comprising the changing surface and a nominal rest position of the edges of the sheet. In the first embodiment, this is achieved by allowing the longitudinal members 16, 18 to move a few millimeters towards each other when the changing surface is loaded. In the second embodiment, the grommets allow the edges of the surface to move a few millimeters towards each other when the surface is loaded, while the longitudinal members 16, 18 move negligibly. In the third embodiment the sheet itself has a very small amount of elasticity, with the longitudinal members 16, 18 and the edges of the sheet moving negligibly.

It will be envisaged that the different embodiments may be combined so long as the total average spring rate in extension of the center line of the sheet with respect to the nominal rest positions of the edges of the sheet is more than 300 N/mm within its normal weight carrying range. It has been found that spring rates in the range 300-2000 Nm are most effective in providing a comfortable bed on which an individual can still be rolled. Torsional coefficients of between 10 and 200 Nm/radian are a useful range for the stiffness of the semi-rigid sheet of material.

In the embodiment of FIG. 5 each of the longitudinal members 16, 18 has curved extensions 25 at each of its ends. The sheet extends to cover these extensions and in this embodiment is fixed to them in the same manner as it is fixed to the longitudinal members. The effect of this is to give a slightly shorter unsupported span of sheet between at either end. Because of this, the sheet will deflect less at the ends, where the head and feet are, compared with at the middle. This has been found to improve comfort for some individuals. In another embodiment the section of the sheet fixed to the extensions 25 is fixed in a different manner to that in which it is fixed to the remainder of the longitudinal members.

What is claimed is:

1. A changing table comprising: a changing surface on which an individual can lie to be changed or washed, thereby providing a load on the surface, wherein the changing surface is formed from a durable semi-rigid sheet having a longitudinal center axis and having also, parallel to the longitudinal center axis, first and second edges occupying nominal rest positions with respect to each other when there is no load on the surface, the first and second edges of the durable semi-rigid sheet being fixed to first and second longitudinal members respectively, the durable semi-rigid sheet and longitudinal members forming together a support system having for the first 10 mm of extension between the longitudinal center axis and the nominal rest position of the first edge of the durable semi-rigid sheet and between the longitudinal center axis and the nominal rest position of the second edge of the durable semi-rigid sheet an average spring rate in extension of more than 300 N/mm and the durable semi-rigid sheet having a torsion coefficient of more than 10 Newton meters/radian, whereby the durable semi-rigid sheet can hammock to an amount in a predetermined manner when lain on by an individual.

2. The changing table of claim 1, wherein the durable semi-rigid sheet is fixed to at least one of the longitudinal members by elastic movement means allowing movement between the members and the durable semi-rigid sheet.

3. The changing table of claim 1, wherein the first and second longitudinal members are fixed to a frame that has for the first 10 mm of compression an average spring rate in compression measured between the longitudinal members of more than 300 N/mm.

4. The changing table of claim 1, wherein that the durable semi-rigid sheet is fixed to at least one longitudinal member by means of a clamping member.

5. The changing table of claim 1, wherein the durable semi-rigid sheet is fixed to at least one of the longitudinal members by means of bolts passing through compressible grommets set in the durable semi-rigid sheet.

6. The changing table of claim 1, wherein the durable semi-rigid sheet is formed from sheet steel.

7. The changing table of claim 1, wherein the durable semi-rigid sheet is formed from polyethylene.

8. The changing table of claim 1, wherein the durable semi-rigid sheet is formed from plywood.

9. The changing table of claim 1, wherein the durable semi-rigid sheet is formed from GRP sheet.

10. The changing table of claim 1, wherein the durable semi-rigid sheet is between 4 mm and 12 mm thick.

11. The changing table of claim 4, wherein the clamping member exerts a clamping force on the durable semi-rigid sheet by means of bolts passing through the durable semi-rigid sheet.

12. The changing table of claim 1, wherein the each longitudinal member incorporates an end part which extends inwards toward the longitudinal center axis and that the durable semi-rigid sheet is fixed to each end part, the sheet extending to cover each end part.

13. The changing table of claim 1, wherein the durable semi-rigid sheet can hammock to about a 20 mm deflection in a predetermined manner when lain on by an individual.

14. The changing table of claim 1, wherein the edges of the durable semi-rigid sheet move towards each other when the surface when lain on by an individual.

15. The changing table of claim 1, further comprising a height adjustment mechanism attached to a frame comprising the first and second longitudinal members.

16. The changing table of claim 15, wherein a pivoting bracket attaches the frame to the height adjustment mechanism.

17. A changing table comprising: a changing surface on which an individual can lie to be changed or washed, thereby providing a load on the surface, wherein the changing surface is formed from a semi-rigid polyethylene sheet having a longitudinal center axis and having also, parallel to the longitudinal center axis, first and second edges occupying nominal rest positions with respect to each other when there is no load on the surface, the edges being fixed by through-bolts to first and second longitudinal members, the semi-rigid polyethylene sheet and longitudinal members forming together a support system, the semi-rigid polyethylene sheet having for the first 10 mm of extension between the longitudinal center axis and the nominal rest position of the first edge and between the center line and the nominal rest position of the second edge an average spring rate in extension of more than 300 N/mm and the semi-rigid polyethylene sheet having a torsion coefficient of more than 10 Newton meters/radian, whereby the semi-rigid polyethylene sheet can hammock an amount in a predetermined manner when lain on by an individual.

18. A changing table comprising: a changing surface on which an individual can lie to be changed or washed, thereby providing a load on the surface, wherein the changing surface is formed from a semi-rigid polymer sheet having a longitudinal center axis and having also, parallel to the longitudinal center axis, first and second edges occupying nominal rest positions with respect to each other when there is no load on the surface, the edges being fixed to first and second longitudinal members, the semi-rigid polymer sheet and longitudinal members forming together a support system having for the first 10 mm of extension between the longitudinal center axis and the nominal rest position of the first edge and between the center line and the nominal rest position of the second edge an average spring rate in extension of more than 300 N/mm and the semi-rigid polymer sheet having a torsion coefficient of more than 10 Newton meters/radian, whereby the sheet can hammock an amount in a predetermined manner but not materially stretch when lain on by an individual.

* * * * *